US008547321B2

(12) United States Patent
Smith

(10) Patent No.: US 8,547,321 B2
(45) Date of Patent: Oct. 1, 2013

(54) LED BACKLIGHT DRIVER SYNCHRONIZATION AND POWER REDUCTION

(75) Inventor: Eric Smith, San Jose, CA (US)

(73) Assignee: Apple Inc., Cupertino, CA (US)

( * ) Notice: Subject to any disclaimer, the term of this patent is extended or adjusted under 35 U.S.C. 154(b) by 992 days.

(21) Appl. No.: 12/178,471

(22) Filed: Jul. 23, 2008

(65) Prior Publication Data

US 2010/0020004 A1 Jan. 28, 2010

(51) Int. Cl.
*G09G 3/36* (2006.01)

(52) U.S. Cl.
USPC ..... 345/102; 345/87; 345/89; 345/92; 345/95; 345/101

(58) Field of Classification Search
USPC ..... 345/55, 82, 589, 690, 691, 87–102, 345/204–213; 315/169.2, 308, 185 R, 250, 315/122, 219, 246, 287–297; 600/425, 453, 600/529, 534; 340/461; 349/62, 70, 71
See application file for complete search history.

(56) References Cited

U.S. PATENT DOCUMENTS 7,002,546 B1 * 2/2006 Stuppi et al. ..... 345/102
7,193,248 B2 * 3/2007 Weindorf et al. ..... 257/100
7,327,337 B2 * 2/2008 Callahan ..... 345/82
7,505,016 B2 * 3/2009 Kwon ..... 345/87
7,508,467 B2 * 3/2009 Odake et al. ..... 349/62
7,750,821 B1 * 7/2010 Taborisskiy et al. ..... 340/815.45
7,855,755 B2 * 12/2010 Weller et al. ..... 349/11
7,923,943 B2 * 4/2011 Peker et al. ..... 315/312
8,174,482 B1 * 5/2012 Yeung ..... 345/102
2002/0140880 A1 * 10/2002 Weindorf et al. ..... 349/70
2004/0207341 A1 * 10/2004 Callahan ..... 315/291
2005/0185113 A1 * 8/2005 Weindorf et al. ..... 349/71
2006/0109137 A1 * 5/2006 Callahan ..... 340/815.45
2007/0013626 A1 * 1/2007 Ando et al. ..... 345/88
2007/0018919 A1 * 1/2007 Zavracky et al. ..... 345/87
2007/0024571 A1 * 2/2007 Maniam et al. ..... 345/102
2007/0030137 A1 * 2/2007 Masters et al. ..... 340/461
2007/0080911 A1 * 4/2007 Liu et al. ..... 345/82
2007/0152926 A1 * 7/2007 Kwon ..... 345/82
2007/0159421 A1 * 7/2007 Peker et al. ..... 345/82
2007/0159750 A1 * 7/2007 Peker et al. ..... 361/93.1
2007/0229446 A1 * 10/2007 Oh et al. ..... 345/102
2008/0088571 A1 * 4/2008 Lee et al. ..... 345/102
2008/0150853 A1 * 6/2008 Peng et al. ..... 345/87

(Continued)

OTHER PUBLICATIONS

Doshi, Montu and Zane, Regan, "Digital Architecture for Driving Large LED Arrays with Dynamic Bus Voltage Regulation and Phase Shifted PWM", Colorado Power Electronics Center (CoPEC), Department of Electrical and Computer Engineering, University of Colorado at Boulder, USA, 1-4244-0714-1/07, 2007 IEEE.

*Primary Examiner* — Prabodh M Dharia
(74) *Attorney, Agent, or Firm* — Fletcher Yoder PC

(57) ABSTRACT

A method and apparatus for providing a LED backlight to a LCD display screen is disclosed. In one embodiment, the apparatus includes: N LED strings, wherein N is an integer greater than or equal to two; a first circuit operable to synchronize a LED clock signal to a LCD timing signal; and a second circuit operable to generate N PWM drive signals synchronized with the LED clock signal, wherein the N PWM drive signals are phase offset from each other by a multiple of 360/N degrees and used to drive respective ones of the N LED strings.

15 Claims, 9 Drawing Sheets

(56) References Cited

U.S. PATENT DOCUMENTS

| | | | | |
|---|---|---|---|---|
| 2008/0174545 | A1* | 7/2008 | Ezaki et al. | 345/102 |
| 2008/0180414 | A1* | 7/2008 | Fung et al. | 345/204 |
| 2008/0192174 | A1* | 8/2008 | Odake et al. | 349/62 |
| 2008/0204431 | A1* | 8/2008 | Chung et al. | 345/204 |
| 2008/0238337 | A1* | 10/2008 | Masood | 315/294 |
| 2008/0266236 | A1* | 10/2008 | Shen et al. | 345/102 |
| 2009/0001252 | A1* | 1/2009 | Korcharz et al. | 250/205 |
| 2009/0015172 | A1* | 1/2009 | Huang et al. | 315/246 |
| 2009/0015174 | A1* | 1/2009 | Huang et al. | 315/250 |
| 2009/0184904 | A1* | 7/2009 | S. et al. | 345/82 |
| 2009/0187925 | A1* | 7/2009 | Hu et al. | 719/327 |
| 2009/0189842 | A1* | 7/2009 | Huang et al. | 345/102 |
| 2009/0230891 | A1* | 9/2009 | Zhao et al. | 315/308 |
| 2009/0322800 | A1* | 12/2009 | Atkins | 345/102 |
| 2010/0020062 | A1* | 1/2010 | Liou et al. | 345/213 |
| 2011/0074839 | A1* | 3/2011 | Liu et al. | 345/690 |

* cited by examiner

LED BACKLIGHT DRIVER SYNCHRONIZATION AND POWER REDUCTION

FIELD OF THE INVENTION

This invention relates to systems and methods for backlighting a liquid crystal display screen, and more particularly to systems and methods for driving light emitting diode backlights for liquid crystal display screens.

BACKGROUND OF THE INVENTION

Many liquid crystal display (LCD) panels filter light from a light source called a backlight to produce images on their display screen. Backlights illuminate the LCD from a side or from the back, and each pixel of the LCD filters the light differently to produce a picture. Backlights can be provided in various colors. For example, color LCD displays may use white backlights, and monochrome LCD displays can have red, yellow, green, blue or white backlights. The backlight can usually be adjusted to produce a light level in a range from dark to full brightness. The level of full brightness depends on the backlight.

A light emitting diode (LED) backlight source can also improve the color range of a LCD display. For example, a LED white light can produce a color spectrum closely matching the color range of the LCD pixels so each color pixel can allow only the desired light spectrum through. This improves the light transmission efficiency of the display since only selectively desired light is produced, and brighter colors can be provided.

Frame rate refers to the frequency at which an imaging device produces unique consecutive images (frames). Frame rate is most often expressed in frames per second or Hertz (Hz). The higher the number of frames per second, the smoother the video appears to the user. Lower frame rates typically result in lower video quality and higher rates typically yield better video quality. As a reference, motion pictures typically use 24 frames/second (24 Hz), the American TV standard (NTSC) uses 60 frames/second (60 Hz), and the European TV standard (PAL) uses 50 frames/second (50 Hz) to allow the viewer to perceive smooth playback.

The refresh rate or vertical refresh rate for a LCD screen refers to the number of times per second (Hz) that the display hardware redraws the image on the screen. This is distinct from the frame rate because a relatively faster refresh rate can allow redrawing of identical frames, while frame rate measures the rate that a video source sends a new frame. For example, movies may have a frame rate of 24 frames per second, but each frame may be drawn (i.e., refreshed) two or three times on a LCD screen before the next frame is presented. Therefore, a movie running at 24 frames per second can have a 48 or 72 Hz refresh rate. Both the refresh rate and frame rate are controlled by LCD timing signals referred to herein as a refresh signal and a frame signal, respectively.

LCD screens may experience a number of problems which are at least partially due to backlighting, such as flickering, shimmering and banding. For example, flickering can be caused when a LED drive signal frequency is relatively slow compared to the frame rate of a LCD screen. In such situations, there may be substantial portions of a frame that are not backlit at a given instant in time. FIG. 1A illustrates one period of an exemplary LED drive signal 102 and two periods of an exemplary LCD refresh signal 104 (also known as a vertical synchronization signal 104). Note, in this example, two periods of the LCD refresh signal 104 corresponds to one frame of an image or picture. As shown in FIG. 1A, the second half of the image frame will have no backlight and, hence, will appear darker than the first half of the image frame. This leads to a blinking or "flickering" effect that is undesirable.

As shown in FIG. 1B, when the LCD refresh signal 104 is out of phase with the LED drive signal 102, additional undesired visual effects may appear in the display, such as shimmering and banding. As its name implies, shimmering resembles a "sparkling" effect that typically occurs when a moving dark object meets or intersects with a lighter one. For example, when tree leaves are blowing in the wind, the leaves may appear to artificially shimmer at the edges of the leaves. The cause of shimmering is similar to that of flickering but is further caused by a phase offset 106 between the LED drive signal 102 and the LCD refresh signal 104, as shown in FIG. 1B. Shimmering typically occurs when this phase offset 106 drifts or changes in time. Banding is similar to shimmering but the phase offset 106 does not drift or change in time, which creates stationary bands of dark areas that are typically evenly spaced across the display screen.

Although LCD display screens may be backlit by fluorescent lights or electroluminescent panels, light emitting diodes (LED's) are increasingly being used to provide backlighting because they are a more efficient and durable method of lighting. LED's have a long operating life, relatively low power consumption, and a broad color range. Therefore, there is a need to provide a method and LCD display that eliminates or reduces some of the problems associated with using LED backlights, such as flickering, shimmering and banding.

SUMMARY OF THE INVENTION

The invention addresses the above and other needs by providing a method and apparatus that substantially reduces or eliminates undesired visual effects such a flickering, shimmering and banding in LCD display panels having a LED backlight source.

In one embodiment of the invention, a LCD panel includes a LED backlight source having a plurality of LED strings that are driven with a desired phase offset from each other. The cumulative effect of the plurality of LED strings is to provide a backlight source that is turned on and off at a higher frequency than any single LED string and at a higher frequency than the frequency of the LCD refresh signal.

In a further embodiment, a method and apparatus for synchronizing the drive signals of a plurality of LED strings with the LCD refresh signal is provided. In one embodiment, the synchronizing circuitry includes a phase lock loop circuit (PLL) for synchronizing a LED reference clock to a refresh signal (e.g., VSYNC) of the LCD screen. The apparatus further includes phase shifting circuitry for shifting the phase of each LED drive signal with respect to one another, and a current balance controller for balancing the current supplied to each LED string.

In another embodiment, a LCD display panel includes a backlight source having N LED strings, where N is an integer greater than or equal to two. The LCD display panel further includes pulse width modulation (PWM) circuitry for generating a duty cycle signal, and a phase shifting circuit for generating N PWM signals which are phase offset from each other and each have a pulse width corresponding to the duty cycle signal, wherein the N PWM signals are used to drive respective ones of the N LED strings.

In one embodiment, the N PWM signals can be phase offset from each other by a multiple of 360/N degrees and the duty cycle of the N PWM signals can be selected to be 100/N % such that the cumulative effect of the N LED strings is to provide a substantially continuous backlight source.

In another embodiment, a method for LED backlighting a display panel includes synchronizing a LED reference clock signal to a LCD refresh signal, generating a plurality of phase-shifted PWM signals, wherein at least one of the phase-shifted PWM signals is synchronized with the LED reference clock signal, and driving a plurality of LED strings with the phase-shifted PWM signals.

In a further embodiment, a method for LED backlighting a display panel includes driving N LED strings that are phase offset from each other by 360/N degrees so as to provide a cumulative effect of a backlight source that turns on and off faster than the frequency of any single LED string. In one embodiment, the N LED strings are driven in a synchronized fashion with respect to a LCD refresh signal. In yet another embodiment, the N LED strings are driven by PWM signals having a duty cycle of 100/N % and phase offset from one another by a multiple of 360/N degrees so as to provide a substantially continuous backlight source. In this latter embodiment, synchronizing with the LCD refresh signal may not be necessary.

Further features and advantages of the invention, as well as the structure and operation of various embodiments of the invention, are described in detail below with reference to the accompanying drawings.

BRIEF DESCRIPTION OF THE DRAWINGS

The following figures are provided for purposes of illustration only and merely depict exemplary embodiments of the invention. These drawings are provided to facilitate the reader's understanding of the disclosure and should not be considered to limit the breadth, scope, or applicability of the disclosure. It should further be noted that these drawings are not necessarily drawn to scale.

DETAILED DESCRIPTION OF EXEMPLARY EMBODIMENTS OF THE INVENTION

In the following description of exemplary embodiments, reference is made to the accompanying drawings which form a part hereof, and in which it is shown by way of illustration specific embodiments in which the invention may be practiced. It is to be understood that other embodiments may be utilized and structural changes may be made without departing from the scope of the invention.

Furthermore, although embodiments of the invention are described herein in terms of systems and methods for providing a LED backlight to a LCD display panel, the invention is not necessarily limited to such devices and other types of backlights and display panels having similar characteristics and problems may be utilized in accordance with the present invention.

Figure 1A:
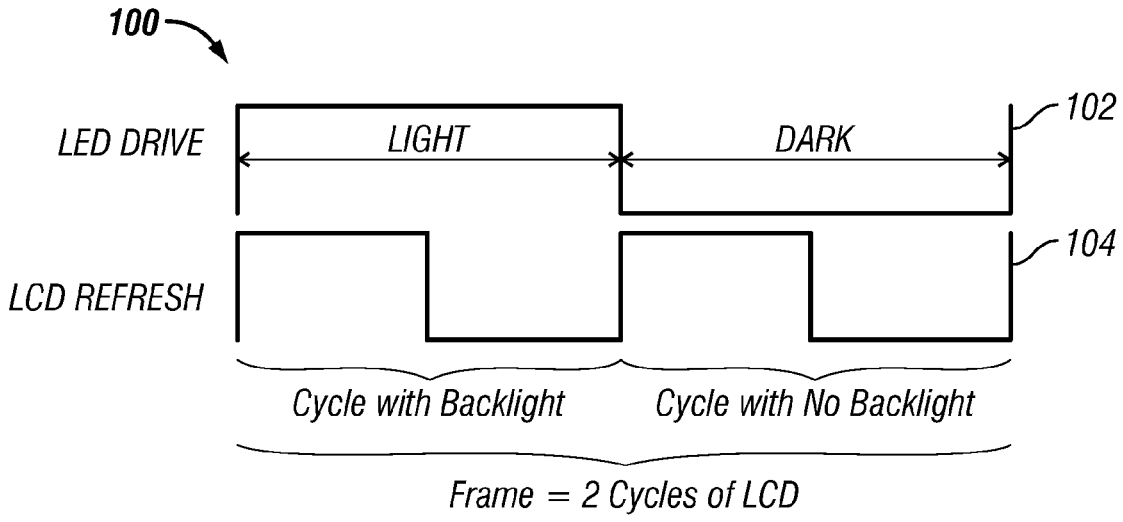
FIG. 1A (Prior Art)
FIG. 1A illustrates a conventional signal diagram illustrating a LED drive signal at a lower frequency than a LCD refresh signal.
Figure 1B:
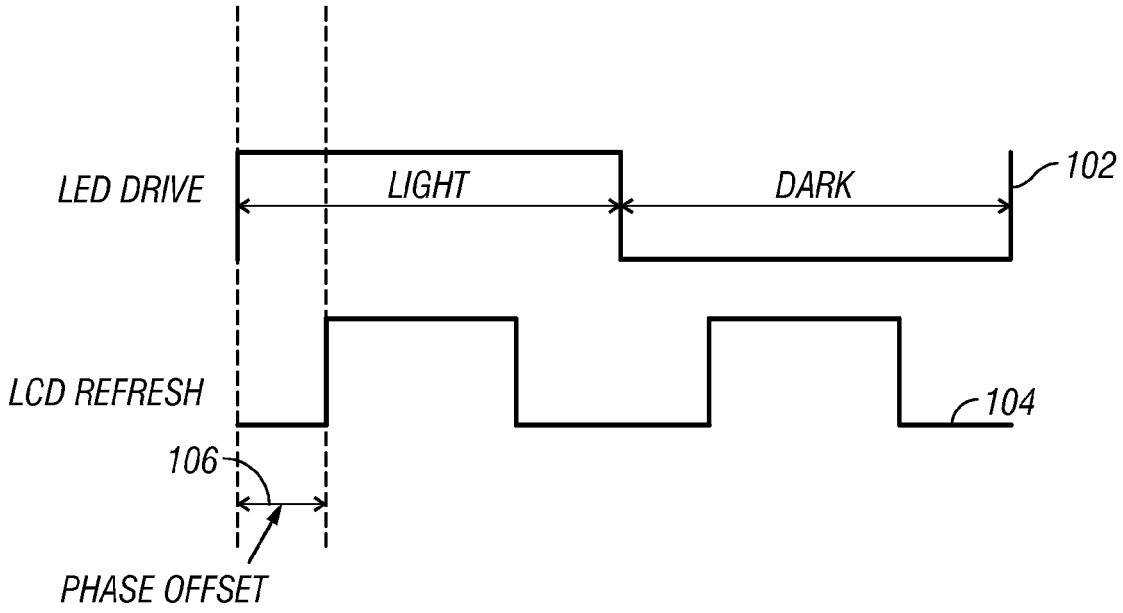
FIG. 1B (Prior Art)
FIG. 1B illustrates a conventional signal diagram illustrating possible phase offsets of a LCD refresh signal relative to a LED drive signal.

As discussed above with respect to FIG. 1, when the frequency of a LED backlight source is relatively slow compared to the refresh rate (or frame rate) of a LCD panel, a substantial portion of an image frame can have no backlighting. This can lead to undesired visual effects such as flickering, shimmering and banding, as described above. However, when a LED backlight source is driven at a higher frequency (e.g., 5-10 times the LCD refresh rate) it provides a smoother backlight source and appears closer to a continuous backlight source, thereby substantially reducing or eliminating undesired visual effects caused by the periodicity of the backlight illumination.

Figure 2:
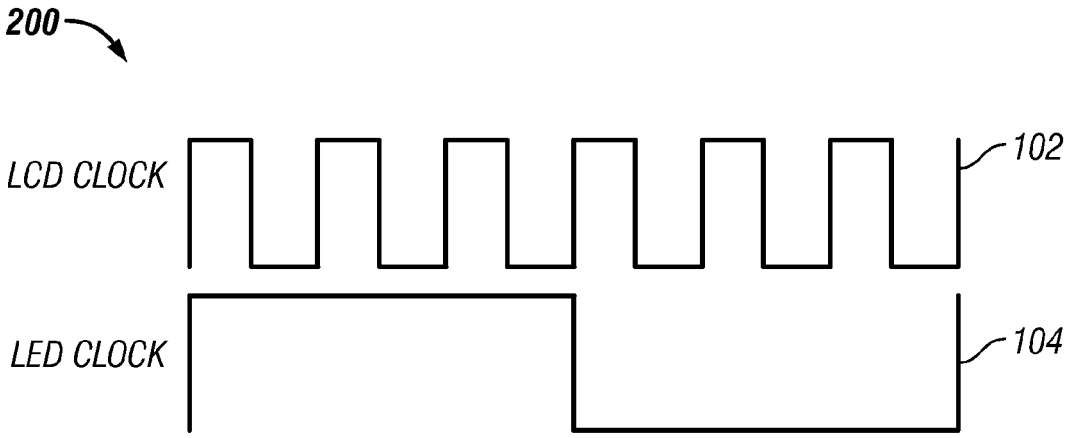
FIG. 2 illustrates an exemplary signal diagram that is representative of a LED backlight source having a higher frequency than a LCD refresh signal, in accordance with one embodiment of the invention.

According to one embodiment of the invention, to obtain the appearance of a continuous backlight within the LCD frame, one set of LEDs (e.g., a LED string) can be driven at a relatively higher frequency when compared to a LCD refresh frequency, as shown in FIG. 2. However, driving a single LED string at high frequencies with a 50% duty cycle results in higher power consumption. Thus, this embodiment may not be suitable for some applications where power consumption is an important criterion.

Alternatively, according to another embodiment of the invention, a plurality of LED strings (e.g., six) can be driven at a lower frequency, with each LED string offset in phase from a previous LED string. The cumulative effect of the phase offset LED strings driven at a lower frequency is to obtain a LED backlight source that appears to be driven at the higher frequency desired to obtain the appearance of a smoother or continuous backlight.

Figure 3:
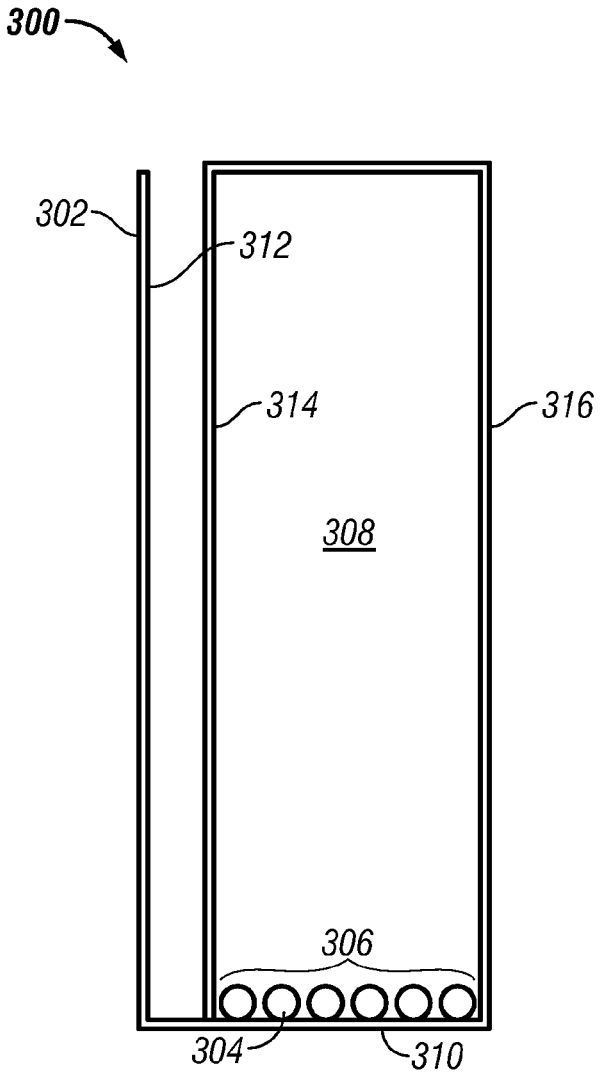
FIG. 3 illustrates a cross section of an exemplary LCD screen with a backlight source comprising a plurality of LED strings and a backlight diffuser, in accordance with one embodiment of the invention.

FIG. 3 is a cross sectional view of an exemplary LCD panel 300, in accordance with one embodiment of the invention. The LCD panel 300 comprises a LCD screen 302, a LED backlight source 306 which includes a plurality of LED strings 304, and a backlight diffuser 308. The LCD screen 302 may be any conventional LCD screen that uses a backlight. In the illustrated embodiment, the LED backlight source 306 includes a group of six LED strings 304, which are placed at a bottom portion 310 of the LCD panel 300. The light emitted by the LED strings 304 is diffused by a diffuser 308 to evenly illuminate a back portion 312 of the LCD screen 302. As discussed in further detail below with respect to FIG. 4, each string of LEDs 304 is driven by respective drive signals which are phase shifted from one another by a predetermined phase offset. In one embodiment, the phase offset is set to be 360 degrees divided by the number of LED strings N (i.e., 360/N degrees).

Although FIG. 3 illustrates a backlight source 306 having six parallel LED strings 304, it is understood that any plurality of LED strings may be utilized in accordance with various embodiments of the invention. Additionally, any number of LED's may be provided on each LED string depending on the dimensions of the LCD screen 302 or the LCD panel 300. For example, ten LEDs may be used on a single LED string.

The backlight diffuser 308 transfers light from the LED strings 304 to the LCD screen 302. Conventional LED and fluorescent backlights employ a diffuser to provide even lighting across a planar screen from a linear light source. In one embodiment, in order for a diffuser to produce even lighting across a LCD display, the light is passed through a layer of transparent material (e.g., a plastic, glass, etc.) that diffuses the light through a series of evenly-spaced bumps whose density increases with the distance from the light source. The bumps scatter and diffuse the light. One side 314 of the diffuser faces the LCD screen 302, and the other side 316 is a reflector to reflect light to the LCD screen 302. Some light from the diffuser 308 will travel in the direction of the LCD screen 302, and the reflector reflects the rest back toward the LCD screen 302.

Figure 4:
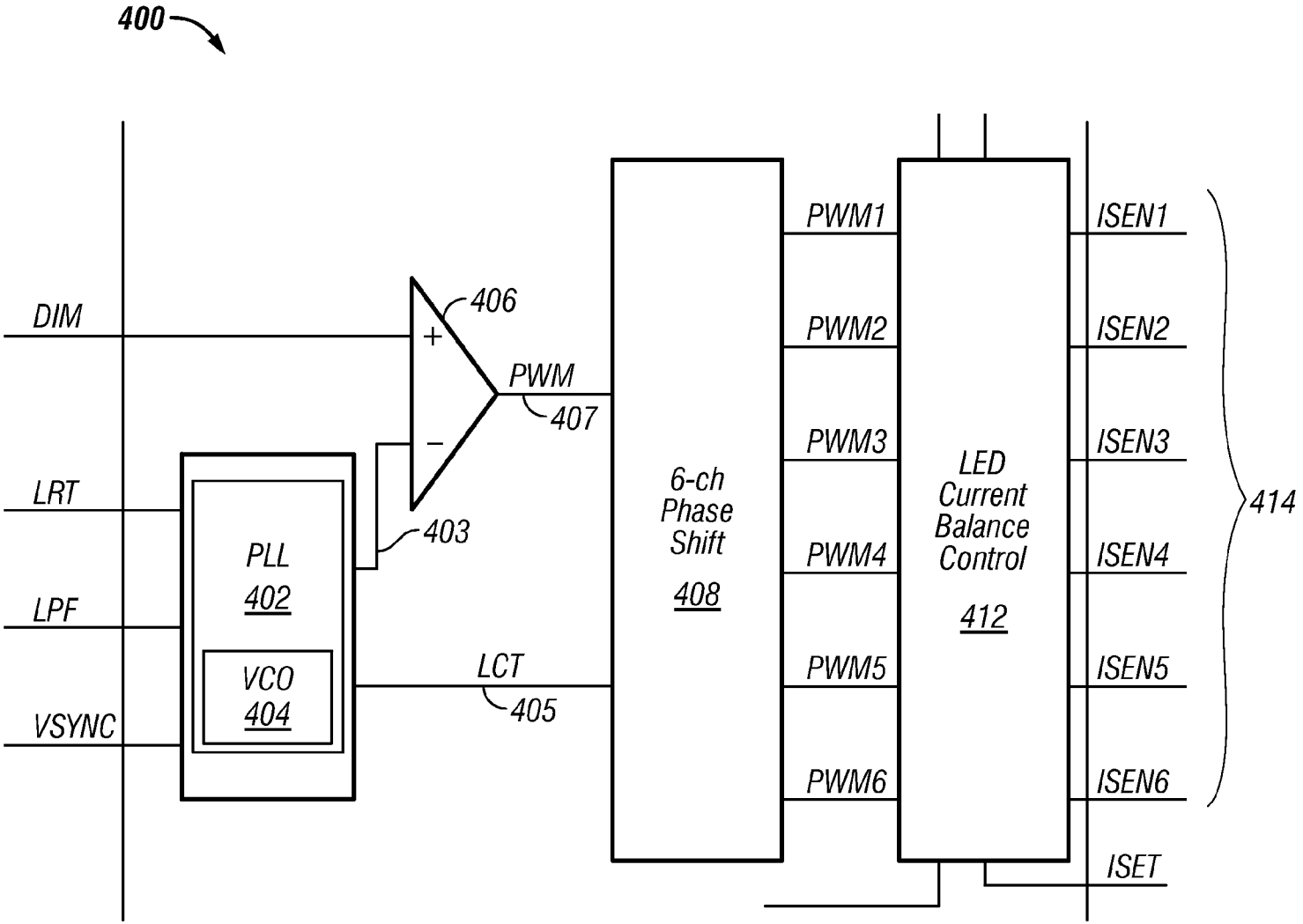
FIG. 4 illustrates an exemplary system for backlighting a LCD screen using a plurality of LED strings (e.g., six), in accordance with one embodiment of the invention.

FIG. 4 illustrates an exemplary system 400 for backlighting a LCD screen using a plurality of LED strings, in accordance with one embodiment of the invention. In this example, six LED strings are used, but the system 400 would function analogously with any plurality of LED strings. System 400 includes a phase lock loop (PLL) circuit 402, which includes a voltage controlled oscillator (VCO) 404, a comparator 406, a six channel phase shifter 408, which outputs six phase shifted pulse width modulated (PWM) signals on six output signal lines 410, a LED current balance controller 412 for receiving the six phase-shifted PWM signals and outputting LED string drive signals on six LED string driver lines 414.

As known in the art, the PLL 402 is a negative feedback control system, which responds to the frequency and phase of a reference clock input signal to automatically raise or lower the frequency of the VCO 404 until its output signal has a phase that matches the phase of the reference signal. In one embodiment, the frequency of the VCO 412 may be set to be a desired multiple M of the frequency of the reference clock signal, where M is an integer greater than or equal to one.

In one embodiment, the refresh signal (VSYNC) for the LCD screen 302 is used as a reference clock to the PLL 402 so that the PLL 402 locks the phase of a LED clock signal (LCT) 405 with the phase of VSYNC. The LCT signal 405 is generally a square wave and is generated by the VCO 404 to have a frequency that is a predetermined multiple of VSYNC. For example, the LCT signal 405 may be selected to have a frequency that is one to ten times that of VSYNC, in accordance with one embodiment of the invention. The frequency of the LCT signal 405 may be set by a control input LRT to the PLL 402, which determines a voltage applied to the VCO 404 and, hence, the frequency of LCT 405. The PLL 402 also includes a second control line LPF which sets the low-pass filter bandwidth of the PLL 402. The PLL 402 may be any conventional PLL circuit that can be used to lock the phase of the LCT signal 405 in fixed relation to the phase of the reference signal (VSYNC), thereby reducing or eliminating optical interference beats (similar to audio Tartini tones) that can cause flickering, shimmering, and banding on the LCD screen 302.

In addition to the LCT output 405, the VCO 404 generates and outputs a second signal 403 that is a saw tooth waveform having a frequency that matches the frequency of LCT 405. The comparator 406 compares a reference signal referred to herein as a "DIM voltage input" or "DIM control signal", applied to its positive input, to the saw tooth-wave signal 403 applied to its negative input. The comparator 406 produces a duty cycle signal 407 by determining an amount of the saw tooth-wave signal 403 having an amplitude less than the DIM voltage. Thus, the duty cycle signal 407 is a function of the DIM voltage. The DIM voltage is used to set the brightness level of the LED backlight 306. In one embodiment, the DIM voltage may be varied between a minimum DIM voltage and a maximum DIM voltage, e.g., 0-3.3 volts DC, to control the LCD panel's brightness.

Both the LCT signal 405 and the duty cycle signal 407 are input to the six-channel phase shifter 408. The phase shifter 408 then generates six pulse width modulated signals (PWM1-PWM7) having a pulse width (i.e., duty cycle) that is determined by the duty cycle signal 407. The frequency of each one of the PWM1-PWM6 signals matches the frequency of the LCT signal 405. The phase shifter 408 offsets the phase of each PWM signal by a desired phase offset. In one embodiment, the phase offset is selected to be 360 degrees divided by the number of PWM signals (which corresponds to the number of LED strings), which in this example is six. The multi-channel phase shifter 408 may include any well-known PWM signal generation circuit and any well known analog or digital delay device or circuit which delays the signal output on each of its output lines by a desired amount of time.

Each of the phase offset PWM signals (PWM1-PWM6) are applied to a respective input of a LED current balance controller 412 that ensures that the current load applied to each of the LED strings 304 is the same. In one embodiment, the current balancer is designed to pull a specific amount of current through each LED string. The amount of current is determined by the normal operating LED current as set by the DIM input and by varying the impedance from each ISENx output (e.g., ISEN1-ISEN6) to ground. The outputs of the current balance control circuit 412 (ISEN1-ISEN6) correspond to the phase and duty cycle of their respective PWM input signals (PWM1-PWM6) and, thus, provide phase offset PWM drive signals to respective LED strings 304.

The phase of each drive signal (ISEN1-ISEN6) determines when a respective LED string 304 will turn on while the duty cycle of each drive signal determines how long each LED string 304 will remain on. Thus, multiple LED strings that are each operating at a relatively slower frequency and lower duty cycle but offset in phase from each other can emulate the effect of a signal LED string operating at a much higher frequency and at a 50% duty cycle. For example, as described in further detail below with respect to FIG. 5, six LED strings each operating at 60 Hz with a 8.33% duty cycle, and offset from each other by sixty degrees (i.e., 360/6 degrees), can emulate a single LED string operating at 360 Hz at a 50% duty cycle. Operating six LED strings at a relatively slower frequency and lower duty cycle requires less power consumption than operating a single LED at a frequency six times higher, and with a 50% duty cycle. Therefore, the invention provides a low power LCD display panel having a LED backlight source that is well suited for applications where energy efficiency is desired (e.g., battery-powered portable electronic devices).

In one embodiment, the phase offset of each drive signal is determined by the formula: $\phi=360/N$ degrees, where N is the number of LED strings in the backlight source. Thus, in the case of six LED strings each LED string is turned on and off with a signal 60 degrees offset from the previous LED signal. For example, PWM2 would be 60 degrees out of phase relative to PWM1, PMW3 would be 60 degrees out of phase relative to PWM2 and 120 degrees relative to PWM1, PWM4 would be 60 degrees out of phase relative to PWM3, and so on.

Figure 5:
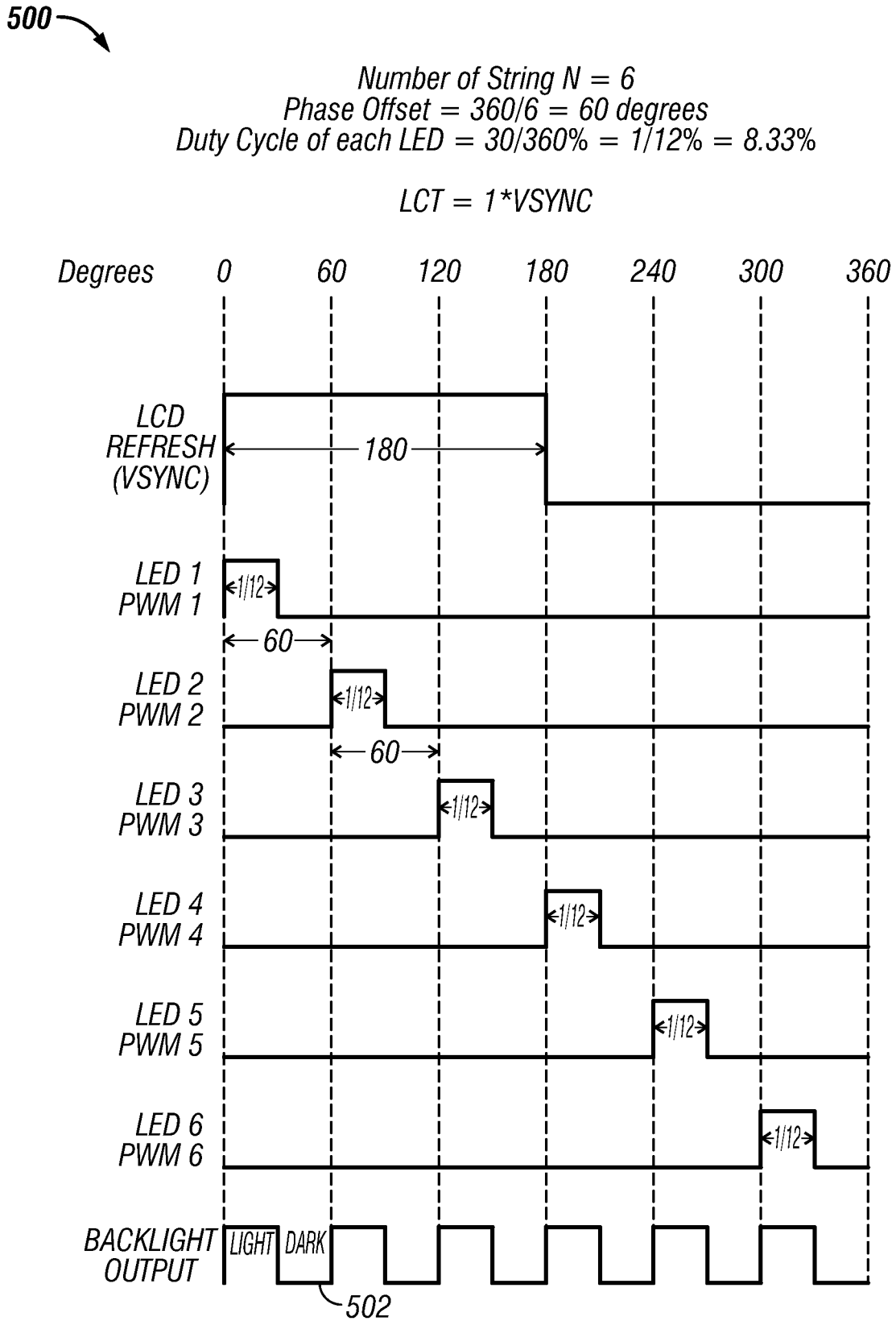
FIG. 5 illustrates exemplary signal diagrams for a LCD refresh signal, six driver signals for six LED strings having a 1/12% (8.33%) duty cycle, and a signal representative of the resulting backlight illumination provided to the LCD panel, in accordance with one embodiment of the invention.

FIG. 5 illustrates an exemplary signal diagram 500 of LED drive signals generated by the system 400 (FIG. 4), in accordance with one embodiment of the invention. The signal diagram 500 illustrates one period of a LCD refresh signal (VSYNC), six driver signals PWM1-PWM6 for six LED strings, and the resulting backlight output according to one embodiment of the invention. In this embodiment, the frequency of the LCT signal 405 is equal to the frequency of VSYNC, which functions as a 50% duty cycle reference clock for the system 400. In order to reduce flicker and other effects caused by the periodicity of the backlight source, LCT 405 (FIG. 4) and VSYNC are synchronized by system 400 as explained above.

The LED driver signals PWM1-PWM6 are synchronized to LCT 405, and hence VSYNC, in the sense that PWM1 will have the same phase and frequency as LCT 405. However, whereas the LCT 405 has a duty cycle of 50%, the duty cycle of the PWM1-PWM6 signals is dictated by the DIM control signal, as discussed above. In the embodiment illustrated in FIG. 5, each PWM drive signal has a 1/12 (8.33%) duty cycle and is phase offset from a previous PWM drive signal by 60 degrees. The sequential activation of each LED string provides a cumulative backlight illumination to the LCD screen 302 that turns on and off as indicated by the representative signal 502. Thus, the cumulative effect of the six LED strings provides a higher frequency backlight source having a higher duty cycle (e.g., 50%) than any of the LED strings alone. As would be apparent to one of skill in the art, the duty cycle of each LED string can be decreased or increased to change the duty cycle of the cumulative backlight illumination to suit different applications and/or power consumption requirements.

Figure 6:
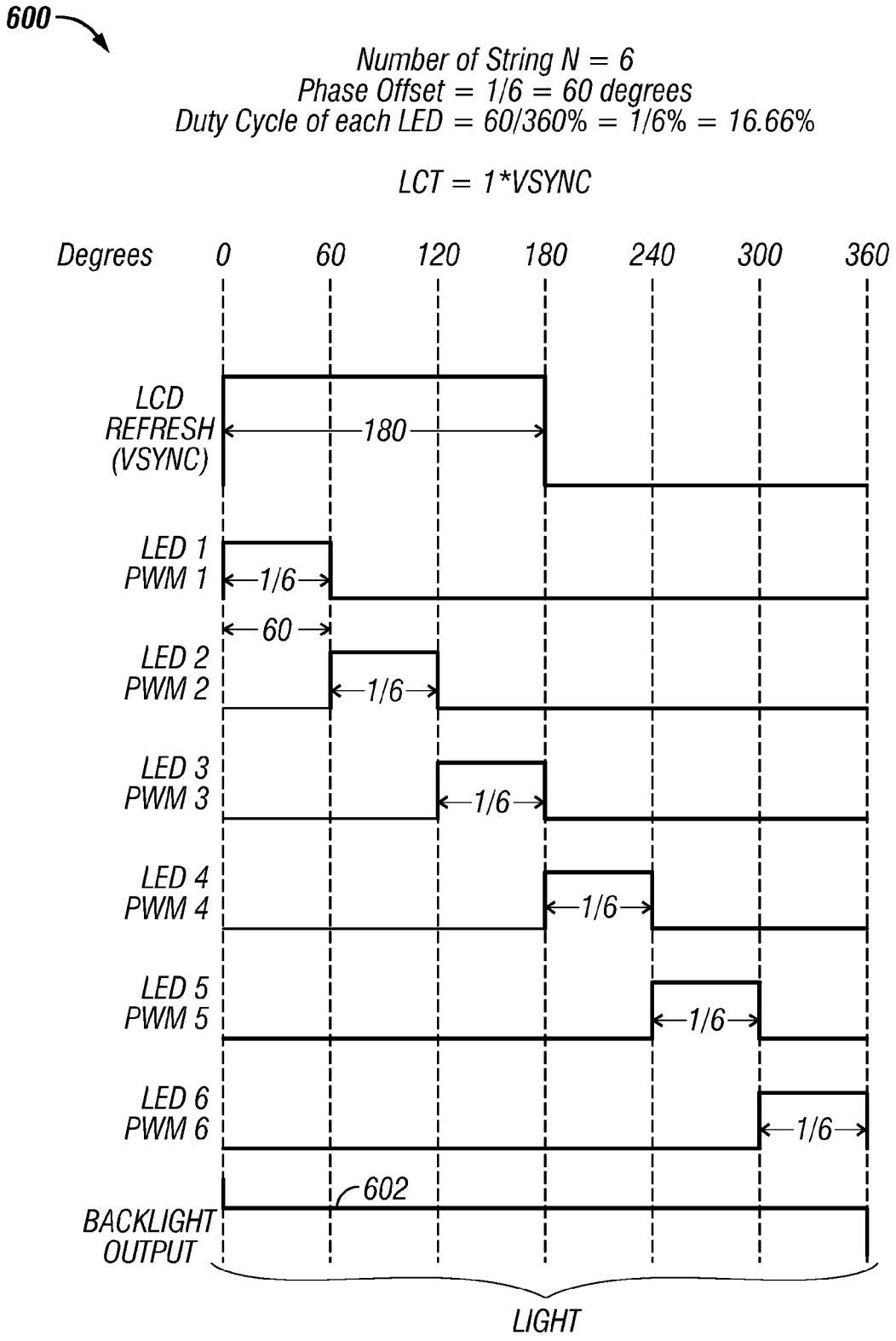
FIG. 6 illustrates exemplary signal diagrams for a LCD refresh signal, six driver signals for six LED strings having a 1/6% (16.66%) duty cycle, and a signal representative of the resulting backlight illumination provided to the LCD patent, in accordance with one embodiment of the invention.

FIG. 6 illustrates an exemplary signal diagram 600 of LED drive signals that can be generated by system 400, in accordance with a further embodiment of the invention. Similar to signal diagram 500, the signal diagram 600 illustrates a LCD refresh signal (VSYNC), six driver signals PWM1-PWM6 for six LED strings, and the resulting backlight output according to an embodiment of the invention. The signal diagram 600 illustrates the same signals as the signal diagram 500 but the duty cycle of each of the LED drive signals is chosen to be equal to (100/N)%, where N is the number LED strings in the LED backlight source 304. When N=6, the duty cycle for each LED drive signal is set to be (100/6)%=16.66%, which means that its pulse width is 16.66% of one of its periods. As shown in FIG. 6, when the phase offset of the driver signals is set to be 360/N with respect to each other and the duty cycle of each drive signal is set to be (100/N)%, the resulting cumulative backlight illumination 602 appears as a continuous light source that is non-periodic. Although providing such a continuous backlight would require higher power consumption than providing the periodic backlight illumination illustrated in FIG. 5, such a continuous light source may be advantageous in applications where power consumption is a less important factor. As would be apparent to one of ordinary skill in the art, if the backlight illumination is continuous and non-periodic as illustrated by signal 602, the problems of flickering, shimmering and banding are eliminated and there is longer a need to synchronize the LED drive signals with VSYNC. Thus, the PLL circuitry 402 may be omitted and the LCT signal 405 and saw tooth waveform 403 may be generated from a system clock or other clock source that has a constant frequency.

Since the cumulative backlight output signal is the sum of the lights of the six LED strings, if the number of LED strings is decreased while holding the duty cycle constant, then the duration of the gaps with no illumination increases as described below with respect to FIG. 7.

Figure 7:
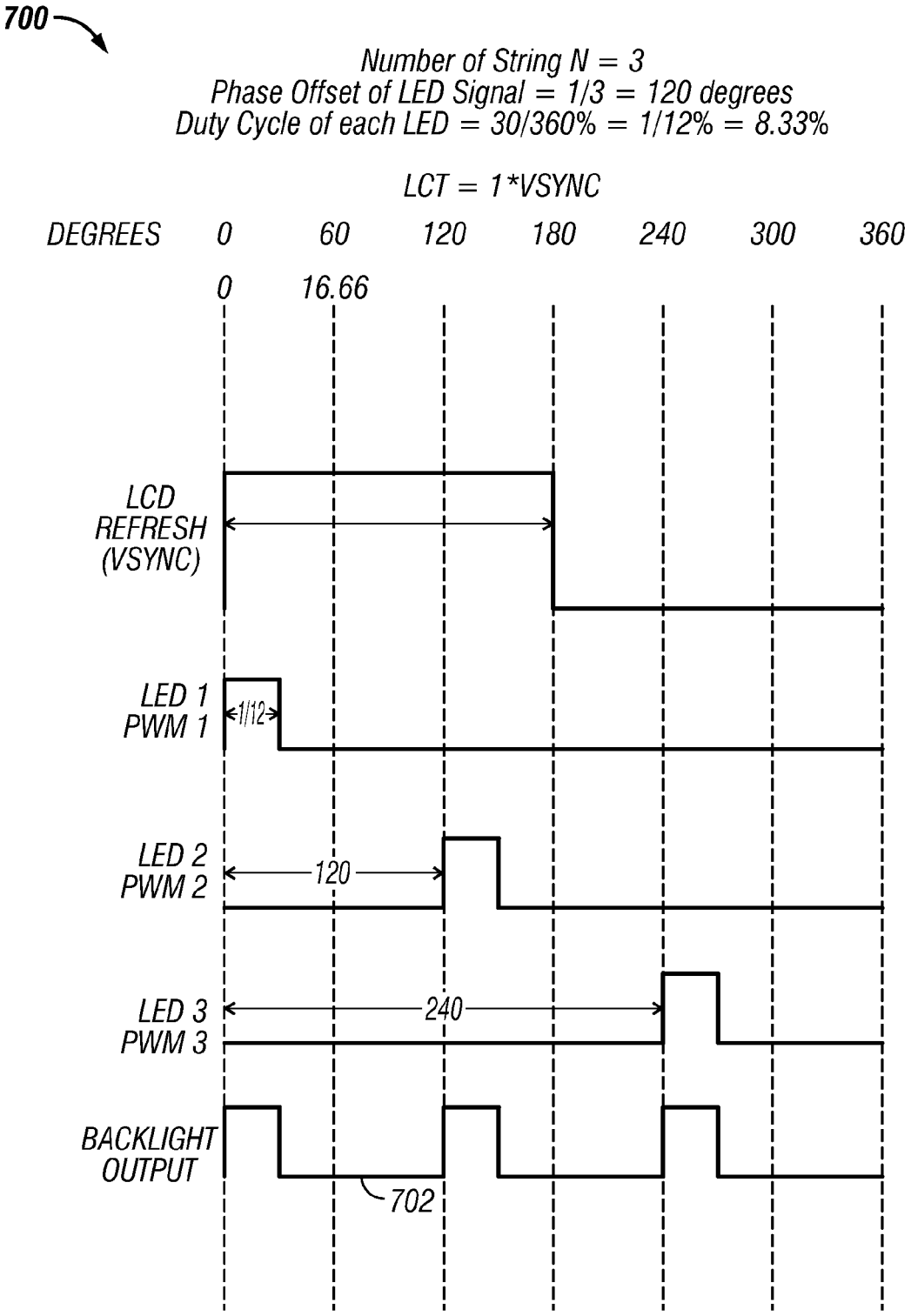
FIG. 7 illustrates exemplary signal diagrams for a LCD clock signal, driver signals for three LED strings having a 8.33% duty cycle, and the resulting backlight illumination provided, in accordance with one embodiment of the invention.

FIG. 7 illustrates an exemplary signal diagram 700 showing three LED drive signals generated by the system 400, in accordance with another embodiment of the invention. The signal diagram 700 illustrates a LCD refresh signal (VSYNC), three driver signals PWM1-3 for three LED strings, and the resulting cumulative backlight output signal, according to an embodiment of the invention. In this embodiment, the LCT frequency is the same as the frequency of VSYNC and is synchronized with VSYNC in order to reduce or eliminate flickering and other undesired visual effects. Both the LCT and VSYNC clock signal have a 50% duty cycle clock. The driver signals PWM1-PWM3 have phase offsets from LCT, and hence VSYNC, of 0, 120 and 240 degrees, respectively, and a duty cycle of 8.33%, which is the same duty cycle illustrated in FIG. 5. By comparing FIG. 7 to FIG. 5, one can see that decreasing the number of LED strings, while maintaining the same duty cycle for each LED drive signal, results in a cumulative backlight signal that has a slower frequency and larger durations of darkness when there is no backlight illumination. As shown in FIG. 7, the gaps 702 show no illumination for approximately 75% of the LCD clock cycle. Thus, when compared to the backlight signal output for six LED strings as shown in FIG. 5, a slower frequency and lower duty cycle cumulative backlight signal is provided when a smaller number of LED strings are used with the same duty cycle. As would be apparent to one of ordinary skill in the art, increasing the number of LED strings would have the opposite effect. That is, the resulting cumulative backlight signal would have a higher frequency and a higher duty cycle with respect to the higher frequency. Therefore, as would be appreciated by one of ordinary skill in the art, the number of LED strings and the duty cycle can be varied in order to suit particular applications.

Figure 8:
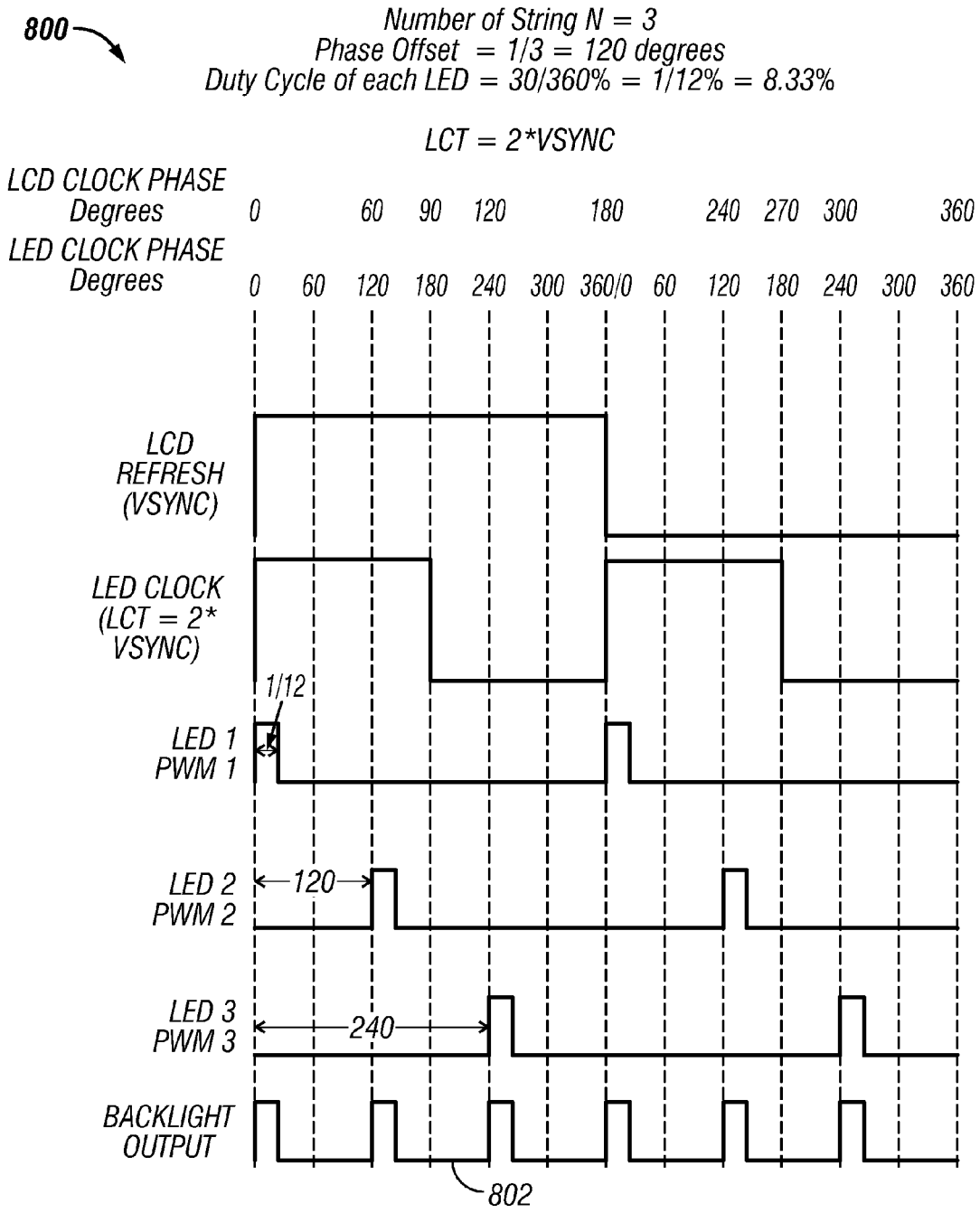
FIG. 8 illustrates exemplary signal diagrams illustrating a LCD refresh signal (VSYNC), a LED clock signal having a frequency=2×VSYNC, three driver signals for three LED strings having a 8.33% duty cycle, and the resulting backlight illumination provided, in accordance with one embodiment of the invention.

Additionally, the frequency of the LCT signal 405 can be varied to suit particular applications. FIG. 8 shows the effect when the frequency of the LCT signal 405 is increased relative to VSYNC while keeping the number of strings the same as that shown in FIG. 7. The signal diagram 800 illustrates a LCD refresh signal (VSYNC), a LCT signal having a frequency that is twice the frequency of VSYNC, three driver signals PWM1-PWM3 for three LED strings, and the resulting backlight output signal according to an embodiment of the invention. As shown in FIG. 8, the gaps 802, which represent the time duration when no backlight illumination is provided, is shorter than the gaps 702 (FIG. 7). Thus, a smoother backlight illumination can be provided when the LED clock frequency is increased, thereby reducing or eliminating the problems of flickering, shimmering and banding. Since the frequency is increased, the duration of time when there is no backlight illumination is decreased with respect to the LCD refresh cycle (and hence Frame cycle), as shown in FIG. 8.

Figure 9:
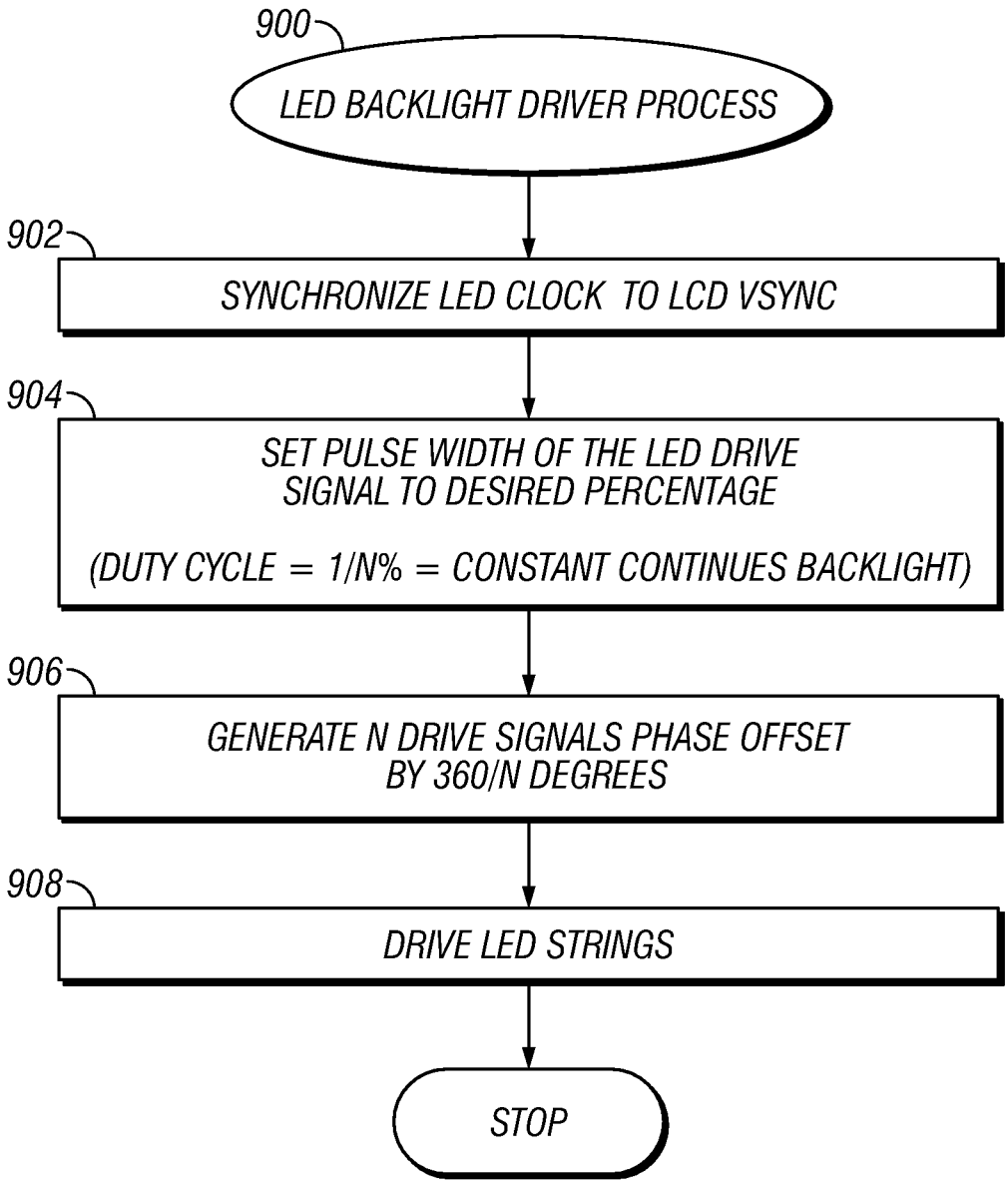
FIG. 9 shows an exemplary flow diagram illustrating a process for LED backlighting, in accordance with one embodiment of the invention.

FIG. 9 shows an exemplary flow diagram illustrating a LED backlight driver process 900 in accordance with one embodiment of the invention. The various tasks performed in connection with process 900 may be performed by hardware, software, firmware, or any combination thereof. It should be appreciated that process 900 may include any number of additional or alternative tasks, the tasks shown in FIG. 9 need not be performed in the illustrated order, and process 900 may be incorporated into a more comprehensive procedure or process having additional functionality not described in detail herein. For illustrative purposes, the following description of process 900 may refer to elements mentioned above in connection with FIGS. 1-8. In various embodiments, portions of process 900 may be performed by different elements of systems 300-400.

The LED backlight driver process 900 may begin by synchronizing a LED clock signal to a LCD refresh signal (step 902). In one embodiment, this synchronization may be accomplished by a phase lock loop (PLL). In a preferred embodiment, the synchronization of the LED clock signal is performed so as to align a rising edge of the LCD refresh signal with a rising edge of the LED clock signal. In other embodiments and depending on the circuit and LED polarity, falling edges or other characteristics of the LED clock signal may be synchronized to corresponding falling edges or other characteristics of the LCD refresh signal. Additionally, for purposes of this disclosure, if a first signal is intentionally offset in phase from a second signal by a predetermined or desired amount, such signals are also said to be synchronized with one another.

The LED backlight driver process 900 continues by setting the duty cycle and, hence, pulse width, of a plurality of PWM signals to a desired value (task 904). For example, as discussed above if the duty cycle of N LED drive signals is set to (100/N)% the resulting backlight source will provide substantially constant and continuous illumination. Setting the duty cycle to less than 100/N % will result in periodic dark periods and hence a periodic backlight signal. Process 900 then generates a plurality of PWM signals phase offset by 360/N degrees with respect to each other to obtain a plurality of phase offset PWM signals (task 906). Next, the LED backlight driver process 900 drives a plurality of LED strings with the phase offset PWM signals (task 908).

Figure 10:
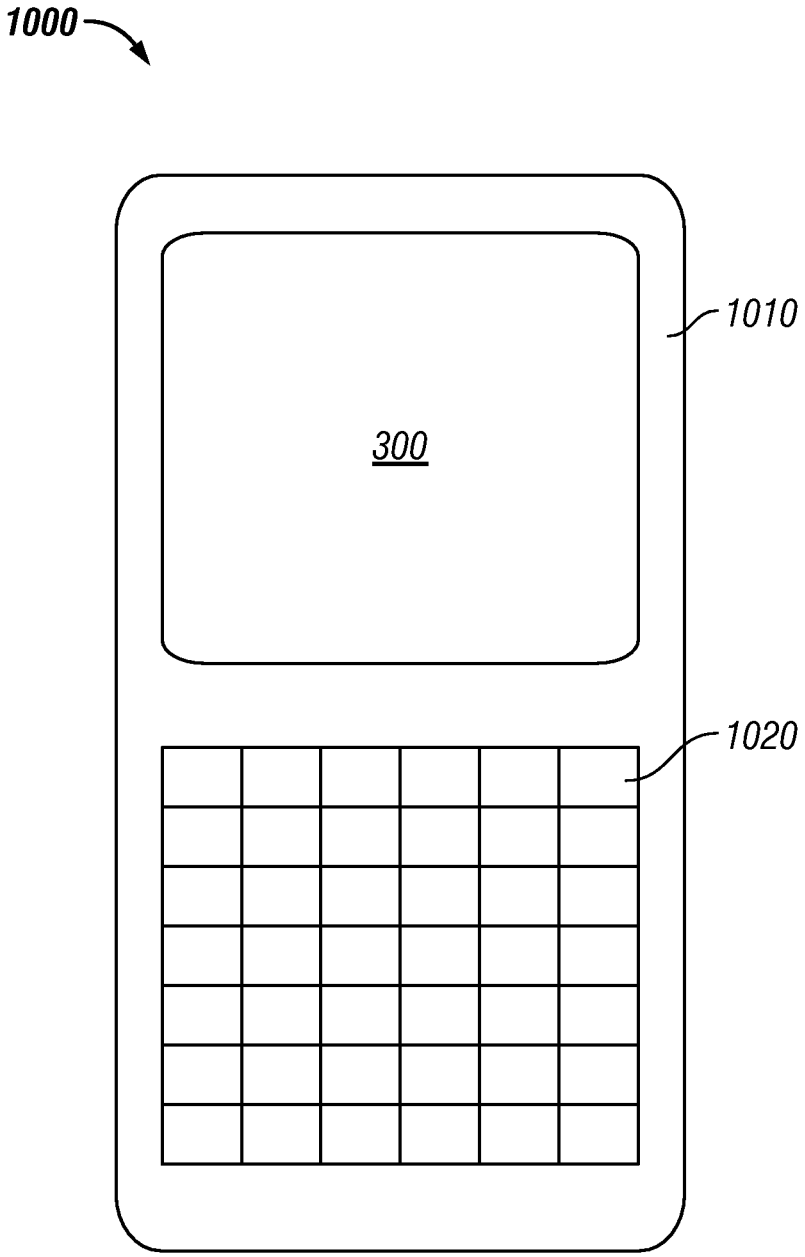
FIG. 10 is a perspective view of an exemplary electronic device incorporating a LCD panel and LED backlight, in accordance with one embodiment of the invention.

FIG. 10 illustrates a perspective view of an exemplary portable electronic device 1000 that incorporates a LCD display panel having a LED backlight source, in accordance with a further embodiment of the invention. The electronic device 1000 includes a housing 1010 which may be formed from any well known rigid material (e.g., metal, metal alloy, plastic, etc.). The electronic device 1000 contains all the circuitry (not shown) necessary to run and operate the device within the housing 1010 and further includes a plurality of input buttons 1020 for receiving input commands from a user of the device 1000. As shown in FIG. 10, the LCD panel 300 (FIG. 3) is at least partially contained within the housing 1010 such that its LCD screen is visible outside of the housing 1010. The remaining components of the LCD panel 300 as shown in FIG. 3, and the drive and synchronization circuitry shown in FIG. 4, are contained with the housing 1010, along with other associated circuitry and components necessary to operate the LCD panel 300.

While various embodiments of the present invention have been described above, it should be understood that they have been presented by way of example only, and not of limitation. For example, although the disclosure is primarily directed at LCD panels having LED backlight sources which reduce or eliminate undesired visual effects such as flickering, shimmering and banding due to the periodicity of LED backlight sources, it is contemplated to be within the scope of the invention that other types of display devices and backlight source having similar characteristics and/or problems associated with a periodic illumination source, may benefit from the present invention. Likewise, the various diagrams depict exemplary circuit configurations and architectures for the invention, which are provided to aid in understanding the features and functionality that can be provided by the invention. The invention is not restricted to the illustrated exemplary circuit configurations and architectures, but can be implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Although the present invention has been fully described in connection with embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A method of providing a backlight from N LED strings to a LCD screen, comprising:

generating N pulse width modulated (PWM) drive signals used to drive respective ones of the N LED strings, wherein light emitted by each of the N LED strings is diffused by a backlight diffuser prior to illuminating the LCD screen;

synchronizing an LED clock signal to an LCD timing signal to reduce or eliminate optical interference beats; and synchronizing at least one of the N PWM drive signals with the LED clock signal;

wherein the N PWM drive signals are phase offset from each other by a multiple of 360/N degrees, where N is an integer greater than or equal to two.

2. The method of claim 1, further comprising:

generating a duty cycle signal; and generating the N PWM drive signals such that each PWM drive signal has a pulse width corresponding to the duty cycle signal.

3. The method of claim 2 wherein the pulse width of each PWM drive signal corresponds to a duty cycle of (100/N) % such that the N LED strings cumulatively provide substantially continuous backlight illumination.

4. The method of claim 2, further comprising balancing the current provided by each of the N PWM drive signals to respective ones of the N LED strings.

5. A method of synchronizing a LED backlight to a LCD screen, comprising:

receiving an LCD timing signal;

generating an LED clock signal;

synchronizing the LED clock signal with the LCD timing signal to reduce or eliminate optical interference beats; and generating at least one drive signal used to drive the LED backlight, wherein the at least one drive signal is synchronized with the LED clock signal, wherein light emitted by the LED backlight is diffused by a backlight diffuser prior to illuminating the LCD screen.

6. The method of claim 5 further comprising generating a duty cycle signal, wherein the at least one driving signal comprises at least one pulse width modulated (PWM) signal having a pulse width corresponding to the duty cycle signal.

7. The method of claim 5 wherein generating at least one drive signal comprises generating N PWM drive signals, where N is an integer greater than or equal to two, and offsetting each PWM drive signal with respect to another PWM drive signal by 360/N degrees in phase.

8. An apparatus for providing a LED backlight to a LCD display screen, comprising:

means for synchronizing an LED clock signal to an LCD timing signal to reduce or eliminate optical interference beats;

means for generating N PWM drive signals synchronized with the LED clock signal, wherein the N PWM drive signals are phase offset from each other by a multiple of 360/N degrees and used to drive respective ones of N LED strings provided by the LED backlight, where N is an integer greater than or equal to two; and means for directing light emitted by the N LED strings onto a back surface of the LCD display screen, wherein the means for directing light comprises means for diffusing the light prior to illuminating the LCD screen.

9. The apparatus of claim 8 further comprising means for setting the frequency of the LED clock signal to be a desired multiple (M) of a frequency of the LCD timing signal, where M is an integer greater than or equal to one.

10. The apparatus of claim 8 further comprising:

means for generating a duty cycle signal; and means for generating the N PWM drive signals such that each N PWM drive signal has a pulse width corresponding to the duty cycle signal.

11. The apparatus of claim 10 further comprising means for balancing a current provided by each of the N PWM drive signals to respective ones of the N LED strings.

12. An apparatus for providing a backlight from N LED strings to a LCD screen, comprising:

means for generating N pulse width modulated (PWM) drive signals used to drive respective ones of the N LED strings, wherein the N PWM drive signals are phase offset from each other by a multiple of 360/N degrees, where N is an integer greater than or equal to two, wherein light emitted by each of the N LED strings is diffused by a backlight diffuser prior to illuminating the LCD screen;

means for synchronizing an LED clock signal to an LCD timing signal to reduce or eliminate optical interference beats; and means for synchronizing at least one of the N PWM drive signals with the LED clock signal.

13. The apparatus of claim 12, further comprising:

means for generating a duty cycle signal; and means for generating the N PWM drive signals such that each PWM drive signal has a pulse width corresponding to the duty cycle signal.

14. An apparatus for synchronizing a LED backlight to a LCD screen, comprising:

means for receiving an LCD timing signal;

means for generating an LED clock signal;

means for synchronizing the LED clock signal with the LCD timing signal to reduce or eliminate optical interference beats;

means for generating at least one drive signal used to drive the LED backlight, wherein the at least one drive signal is synchronized with the LED clock signal, and means for directing light emitted by the LED backlight onto a back surface of the LCD display screen, wherein the means for directing light comprises means for diffusing the light prior to illuminating the LCD screen.

15. The apparatus of claim 14 wherein the means for generating at least one drive signal comprises means for generating N PWM drive signals, where N is an integer greater than or equal to two, and means for offsetting each PWM drive signal with respect to another PWM drive signal by 360/N degrees in phase.

* * * * *